US008989827B2

(12) United States Patent
Tamura

(10) Patent No.: US 8,989,827 B2
(45) Date of Patent: Mar. 24, 2015

(54) SUPERCONDUCTING MAGNET

(75) Inventor: Hajime Tamura, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 138 days.

(21) Appl. No.: 13/885,011

(22) PCT Filed: Mar. 22, 2011

(86) PCT No.: PCT/JP2011/056767

§ 371 (c)(1),
(2), (4) Date: May 13, 2013

(87) PCT Pub. No.: WO2012/127604

PCT Pub. Date: Sep. 27, 2012

(65) Prior Publication Data

US 2013/0237426 A1 Sep. 12, 2013

(51) Int. Cl.
*H01F 6/06* (2006.01)
*H01F 6/04* (2006.01)

(52) U.S. Cl.
CPC ..... *H01F 6/04* (2013.01)
USPC ..... 505/163; 505/211

(58) Field of Classification Search
CPC ..... H01F 6/065; G01R 33/3815
USPC ..... 505/163, 211
See application file for complete search history.

(56) References Cited

FOREIGN PATENT DOCUMENTS

| | | | |
|---|---|---|---|
| JP | 1-101614 | A | 4/1989 |
| JP | 2-78208 | A | 3/1990 |
| JP | 2-81486 | A | 3/1990 |
| JP | 2-218184 | A | 8/1990 |
| JP | 4-78175 | A | 3/1992 |
| JP | 4-361526 | A | 12/1992 |
| JP | 5-133432 | A | 5/1993 |
| JP | 8-78737 | A | 3/1996 |
| JP | 11-176630 | A | 7/1999 |
| WO | WO 2008/153036 | A1 | 12/2008 |

OTHER PUBLICATIONS

*International Search Report (PCT/ISA/210) issued on Jun. 21, 2011, by the Japanese Patent Office as the International Searching Authority for International Application No. PCT/JP2011/056767.
*Decision to Grant Patent mailed Feb. 14, 2012 in Japanese Patent Application No. 2011-537462.
*Informal Comments on the Written Opinion of the International Searching Authority.

*Primary Examiner* — Colleen Dunn
(74) *Attorney, Agent, or Firm* — Buchanan Ingersoll & Rooney PC

(57) ABSTRACT

A superconducting magnet includes a superconducting coil, a heat shield surrounding the superconducting coil, a vacuum chamber accommodating the heat shield, a magnetic shield covering at least a part of the vacuum chamber, and a refrigerating machine fixed to the vacuum chamber to cool the superconducting coil through a heat conducting body. The magnetic shield abuts against said vacuum chamber with an elastic body therebetween to support the vacuum chamber.

15 Claims, 3 Drawing Sheets

SUPERCONDUCTING MAGNET

TECHNICAL FIELD

The present invention relates to a superconducting magnet.

BACKGROUND ART

Japanese Patent Laying-Open No. 2-78208 (PTD 1) is a related art document disclosing a configuration of a superconducting magnet. According to the superconducting magnet disclosed in Japanese Patent Laying-Open No. 2-78208 (PTD 1), one side of a flange of a refrigerating machine port is attached to a magnetic shield through a vibration-proof body. Further, the other side of the flange of the refrigerating machine port is coupled to bellows constituting a vacuum chamber.

CITATION LIST

Patent Document

PTD 1: Japanese Patent Laying-Open No. 2-78208

SUMMARY OF INVENTION

Technical Problem

According to the superconducting magnet disclosed in Japanese Patent Laying-Open No. 2-78208 (PTD 1), the magnetic shield and the vacuum chamber are assembled to integrate by means of connection parts such as bellows, a bellows flange, a bolt, a nut, and the like, rendering the structure to be complicated, and each constituting part to be an application-specific part, thereby causing lack of versatility.

The present invention was achieved in view of the problem described above, and its object is to provide a superconducting magnet having a simple structure.

Solution to Problem

A superconducting magnet in accordance with the present invention includes a superconducting coil, a heat shield surrounding the superconducting coil, a vacuum chamber accommodating the heat shield, a magnetic shield covering at least a part of the vacuum chamber, and a refrigerating machine fixed to the vacuum chamber to cool the superconducting coil through a heat conducting body. The magnetic shield abuts against the vacuum chamber with an elastic body therebetween to support the vacuum chamber.

Advantageous Effects of Invention

According to the present invention, the structure of a superconducting magnet can be simplified.

DESCRIPTION OF EMBODIMENTS

Figure 1:
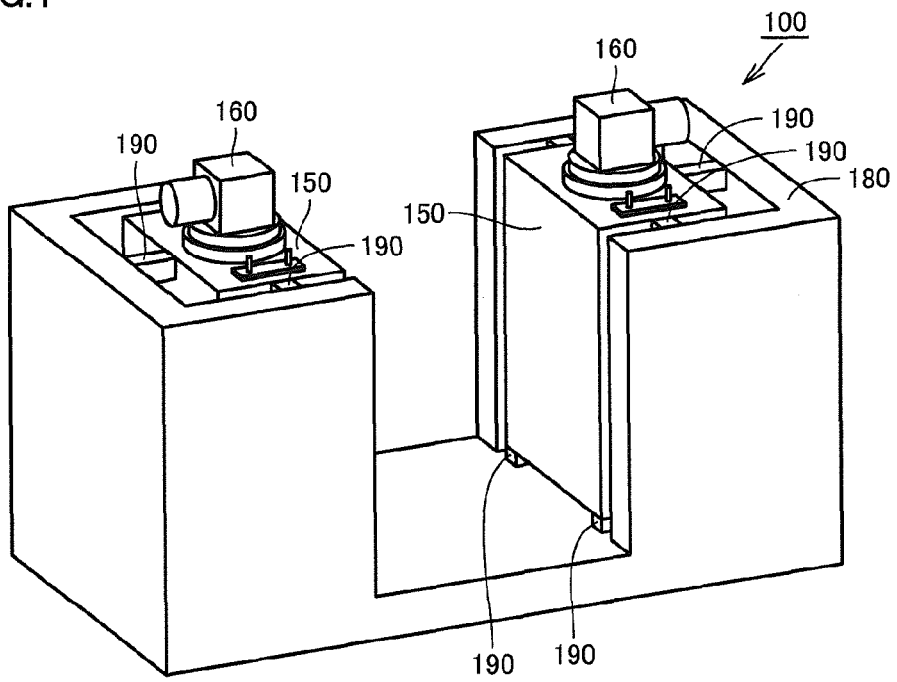
FIG. 1 is a perspective view representing an appearance of a superconducting magnet according to a first embodiment of the present invention.

Hereinafter, a superconducting magnet according to the first embodiment of the present invention will be described with reference to the drawings. In the following description of the embodiments, the same or corresponding parts in the drawings have the same reference numerals allotted, and description thereof will not be repeated.

(First Embodiment)

Figure 2:
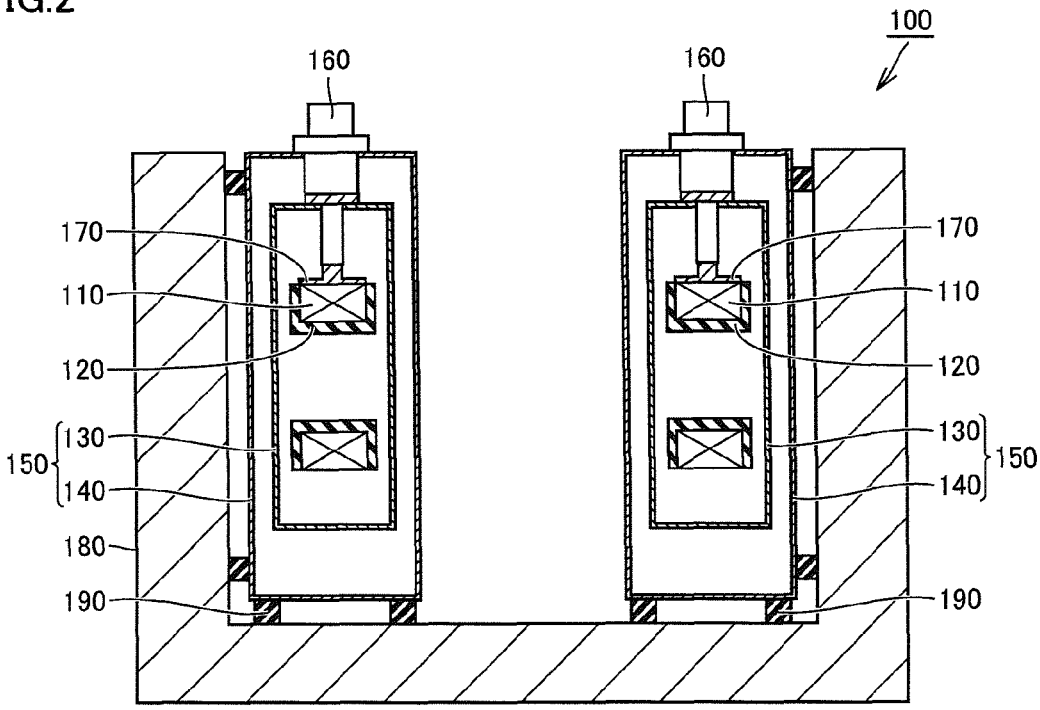
FIG. 2 is a cross-sectional view representing a configuration of the superconducting magnet according to the first embodiment of the present invention.

FIG. 1 is a perspective view representing appearance of the superconducting magnet according to the first embodiment of the present invention. FIG. 2 is a cross-sectional view representing a configuration of the superconducting magnet according to the first embodiment of the present invention.

As shown in FIGS. 1 and 2, a superconducting magnet 100 according to the first embodiment of the present invention includes a superconducting coil 110, a heat shield 130 surrounding superconducting coil 110, and a vacuum chamber 140 accommodating heat shield 130. Heat shield 130 and vacuum chamber 140 constitute a cryostat 150. Further, superconducting magnet 100 includes a magnetic shield 180 covering at least a part of vacuum chamber 140, and a refrigerating machine 160 fixed to vacuum chamber 140 to cool the superconducting coil through heat conducting body 170. Magnetic shield 180 abuts against vacuum chamber 140 with an elastic body 190 therebetween to support vacuum chamber 140.

Superconducting magnet 100 according to the present embodiment is a superconducting magnet of so-called conductive cooling type allowing refrigerating machine 160 and superconducting coil 110 to thermally come in contact with each other to cool superconducting coil 110.

Hereinafter, each element of superconducting magnet 100 according to the present embodiment will be described. Superconducting magnet 100 according to the present embodiment includes two of each superconducting coil 110, heat shield 130, vacuum chamber 140, and refrigerating machine 160. The configuration of the superconducting magnet is not limited to this, and is arbitrary as long as at least one superconducting coil 110, heat shield 130, vacuum chamber 140, and refrigerating machine 160 are included.

Superconducting coil 110 includes a superconducting wire made of niobium-titanium alloy and is wound around a cylindrical bobbin 120. Material of the superconducting wire is not limited to niobium-titanium alloy, and the material may be, for example, niobium-tin alloy. Bobbin 120 is formed from stainless steel, but the material of bobbin 120 is not limited to this.

Heat shield 130 prevents intrusion of heat into superconducting coil 110 due to thermal radiation from outside. Heat shield 130 is formed from aluminum. However, material of heat shield 130 is not limited to this, and any material having superior thermal conductivity may be employed.

Vacuum chamber 140 accommodates superconducting coil 110, bobbin 120, and heat shield 130. Vacuum chamber 140 provides vacuum insulation between the inside and outside of vacuum chamber 140. Both heat shield 130 and vacuum chamber 140 are structures for preventing intrusion of heat into superconducting coil 110.

In the present embodiment, vacuum chamber 140 has a substantially cuboid profile. However, the profile of vacuum chamber 140 is not limited to this, and a substantially cylindrical profile may be employed. Two vacuum chambers 140 are arranged such that respective side surfaces face with each other.

Refrigerating machine 160 includes two-stage cooling portions. A first stage cooling portion of refrigerating machine 160 is in contact with heat shield 130. A second stage cooling portion as a tip portion of refrigerating machine 160 is in contact with superconducting coil 110 through heat conducting body 170 made of, for example, copper.

Magnetic shield 180 is formed from a magnetic body such as iron having a thickness greater than or equal to 100 mm to effectively reduce leakage of a magnetic field from superconducting magnet 100 to outer portion. Magnetic shield 180 covers side surfaces excluding the side surfaces facing each other the and bottom surfaces of two vacuum chambers 140.

Elastic body 190 is made of rubber in the present embodiment. However, elastic body 190 is not limited to this, and elements capable of absorbing vibration, such as a spring made of metal, a spring made of resin, or a damper, may be employed.

In the present embodiment, elastic bodies 190 are spaced apart at predetermined intervals and arranged between the bottom surface of vacuum chamber 140 and magnetic shield 180, and between the side surfaces of vacuum chamber 140 and magnetic shield 180. Elastic bodies 190 are bonded to either vacuum chamber 140 or magnetic shield 180.

Hereinafter, operation performed during generation of a magnetic field in superconducting magnet 100 will be described.

Firstly, to bring superconducting coil 110 to a superconducting state, the pressure in vacuum chamber 140 is reduced to attain vacuum. Thereafter, refrigerating machine 160 is operated. Heat shield 130 is cooled down to about 60K by the first stage cooling portion of refrigerating machine 160. Superconducting coil 110 is eventually cooled down to a temperature less than or equal to 4K by the second stage cooling portion of refrigerating machine 160.

After heat shield 130 and superconducting coil 110 are cooled sufficiently, current is applied to superconducting coil 110 through a lead wire from an unillustrated external power supply device to generate a magnetic field. In the present embodiment, the region between the respective surfaces of two vacuum chambers 140 facing each other is a region of using the generated magnetic field.

Since the refrigerating machine is of a reciprocating expansion machine type, driving of the refrigerating machine generates vibration. The vibration propagates to cryostat 150. Since elastic bodies 190 are arranged between vacuum chamber 140 and magnetic shield 180, the vibration of refrigerating machine 160 is attenuated by elastic body 190. Therefore, almost no vibration propagates to magnetic shield 180.

Reducing the propagation of vibration of refrigerating machine 160 through magnetic shield 180 to a floor surface having magnetic shield 180 provided thereon can suppress influence of the vibration to precise measuring equipment arranged around superconducting magnet 100.

Superconducting magnet 100 of the present embodiment can suppress propagation of the vibration of refrigerating machine 160 by employing a simple structure of allowing magnetic shield 180 to abut against vacuum chamber 140 with elastic bodies 190 therebetween to support vacuum chamber 140. Therefore, elastic bodies 190 are arranged in accordance with the profile of cryostat 150, in other words, the profile of vacuum chamber 140, so that the countermeasure to the vibration of superconducting magnet 100 can be taken, and superconducting magnet 100 can have a structure with superior versatility.

Hereinafter, a superconducting magnet according to the second embodiment of the present invention will be described. A superconducting magnet 200 of the present embodiment is different from superconducting magnet 100 of the first embodiment in the method of cooling superconducting coil 110. Therefore, description as to the same configuration as superconducting magnet 100 of the first embodiment will not be repeated.

(Second Embodiment)

Figure 3:
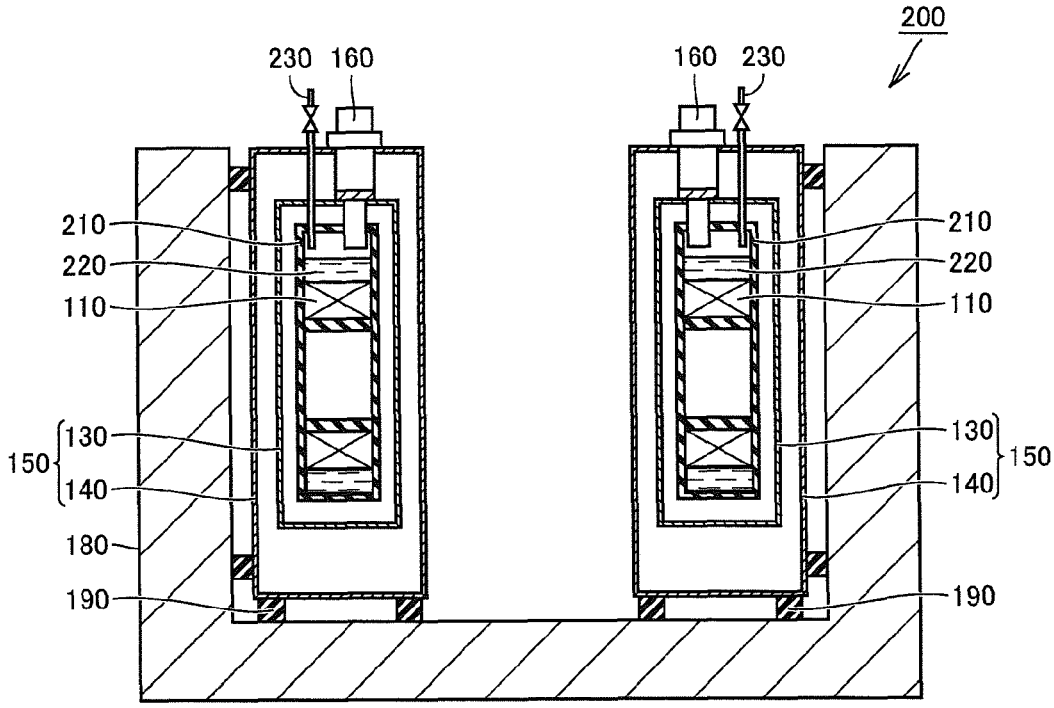
FIG. 3 is a cross-sectional view representing a configuration of a superconducting magnet according to a second embodiment of the present invention.

FIG. 3 is a cross-sectional view representing a configuration of a superconducting magnet according to the second embodiment of the present invention. As shown in FIG. 3, superconducting magnet 200 according to the second embodiment of the present invention includes superconducting coil 110, a helium tank 210 accommodating superconducting coil 110 and storing liquid helium 220 inside, heat shield 130 surrounding helium tank 210, and vacuum chamber 140 accommodating heat shield 130. Heat shield 130 and vacuum chamber 140 constitute cryostat 150. Superconducting magnet 200 includes magnetic shield 180 covering at least a part of vacuum chamber 140, and refrigerating machine 160 fixed to vacuum chamber 140 and liquefying evaporated liquid helium 220 to cool superconducting coil 110. Magnetic shield 180 abuts against vacuum chamber 140 with elastic bodies 190 therebetween to support vacuum chamber 140.

Superconducting magnet 200 according to the present embodiment is a superconducting magnet employing so-called helium cooling method of cooling superconducting coil 110 by immersing the coil into liquid helium 220.

Hereinafter, each element of superconducting magnet 200 according to the present embodiment will be described. Superconducting magnet 200 of the present embodiment includes two of each superconducting coil 110, helium tank 210, heat shield 130, vacuum chamber 140, and refrigerating machine 160. The configuration of the superconducting magnet is not limited to this, and is arbitrary as long as at least one superconducting coil 110, helium tank 210, heat shield 130, vacuum chamber 140, and refrigerating machine 160 are included.

Helium tank 210 has an O-shaped profile. Superconducting coil 110 is wound around a shaft portion of helium tank 210. A helium pipe 230 is coupled to an upper portion of helium tank 210. Helium pipe 230 serves to introduce liquid helium 220 and discharge helium gas evaporated from liquid helium 220. Liquid helium 220 stored in helium tank 210 cools superconducting coil 110.

The first stage cooling portion of refrigerating machine 160 is in contact with heat shield 130. The second stage cooling portion as a tip of refrigerating machine 160 is in contact with liquid helium evaporated in helium tank 210 and cools the evaporated liquid helium to re-liquefy the helium again.

Also in the present embodiment, since elastic bodies 190 are arranged between vacuum chamber 140 and magnetic shield 180, vibration of refrigerating machine 160 is attenuated by elastic bodies 190, so that almost no vibration propagates to magnetic shield 180.

Reducing the propagation of vibration of refrigerating machine 160 through magnetic shield 180 to a floor surface having magnetic shield 180 provided thereon can suppress influence of the vibration to precise measuring equipment arranged around superconducting magnet 100.

Superconducting magnet 200 of the present embodiment can suppress propagation of the vibration of refrigerating machine 160 by employing a simple structure of allowing magnetic shield 180 to abut against vacuum chamber 140 with elastic bodies 190 therebetween to support vacuum chamber 140. Therefore, elastic bodies 190 are arranged in accordance with a profile of cryostat 150, in other words, a profile of vacuum chamber 140, so that the countermeasure to the vibration of superconducting magnet 200 can be taken, and superconducting magnet 200 can have a structure with superior versatility.

Hereinafter, a superconducting magnet according to the third embodiment of the present invention will be described. Superconducting magnet 300 of the present embodiment is different from superconducting magnet 100 of the first embodiment in the arrangement of the refrigerating machines. Therefore, description as to the same configuration as superconducting magnet 100 of the first embodiment will not be repeated.

(Third Embodiment)

Figure 4:
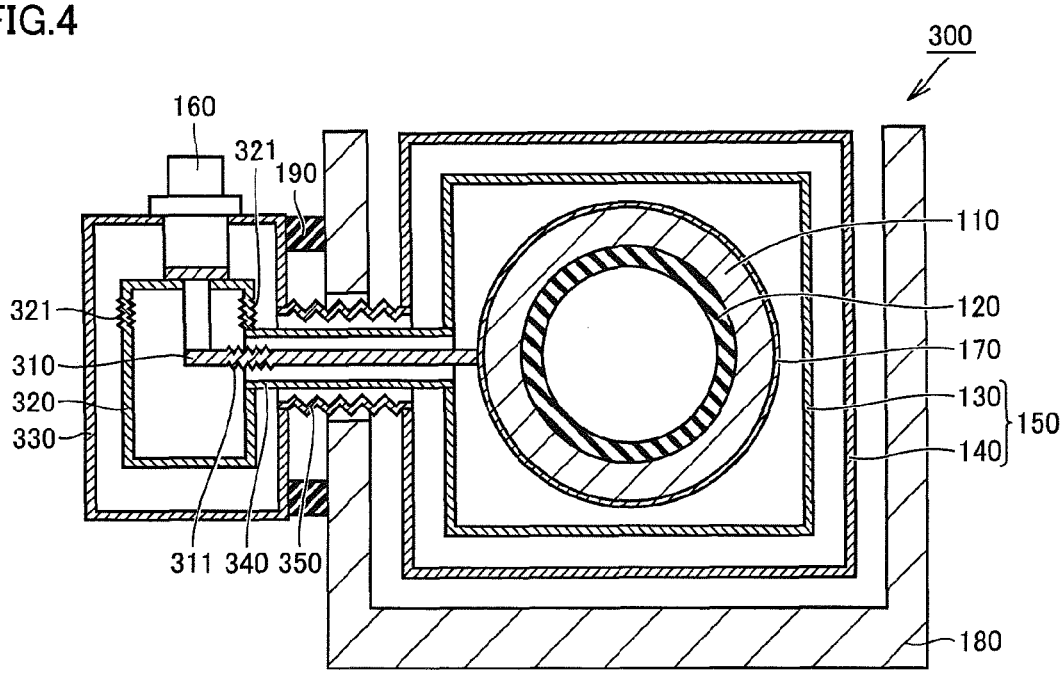
FIG. 4 is a cross-sectional view representing a configuration of a superconducting magnet according to a third embodiment of the present invention.

FIG. 4 is a cross-sectional view representing a configuration of a superconducting magnet according to the third embodiment of the present invention. As shown in FIG. 4, superconducting coil 110 is wound around bobbin 120. Heat shield 130 surrounds superconducting coil 110. Vacuum chamber 140 accommodates heat shield 130. Refrigerating machine 160 is thermally connected to superconducting coil 110 through heat conducting body 170 and heat conducting body 310.

In superconducting magnet 300 according to the third embodiment of the present invention, a part 330 of vacuum chamber 140 including a part having refrigerating machine 160 fixed thereon is positioned outside of magnetic shield 180. Magnetic shield 180 abuts against part 330 of vacuum chamber 140 with elastic bodies 190 therebetween to support vacuum chamber 140.

In particular, part 330 of the vacuum chamber 140 positioned outside of magnetic shield 180 and the other part of vacuum chamber 140 positioned inside magnetic shield 180 are coupled by bellows 350. Bellows 350 suppress propagation of vibration from part 330 of vacuum chamber 140 positioned outside of magnetic shield 180 to other part of vacuum chamber 140 positioned inside magnetic shield 180.

A part 320 of heat shield 130 is also positioned outside of magnetic shield 180. Part 320 of heat shield 130 positioned outside of magnetic shield 180 and the other part of heat shield 130 positioned inside of magnetic shield 180 are coupled by coupling pipe heat shield 340.

Part 320 of heat shield 130 incorporates a copper braided wire 321. Copper braided wire 321 efficiently conducts heat and suppresses propagation of vibration from part 320 of heat shield 130 positioned outside of magnetic shield 180 to the other part of heat shield 130 positioned inside of magnetic shield 180.

Part 320 of heat shield 130 is in contact with the first stage cooling portion of refrigerating machine 160, so that heat shield 130 is cooled down to about 60K.

Heat conducting body 310 also incorporates copper braided wire 311. Copper braided wire 311 efficiently conducts heat and suppresses propagation of vibration from refrigerating machine 160 to superconducting coil 110.

Heat conducting body 310 is in contact with the second stage heat cooling portion of refrigerating machine 160, so that superconducting coil 110 is cooled down to about 4K through heat conducting body 170.

Part 330 of vacuum chamber 140 abuts against magnetic shield 180 with elastic bodies 190 therebetween, so that vacuum chamber 140 is supported by magnetic shield 180. Therefore, propagation of vibration of refrigerating machine 160 to a floor surface and magnetic shield 180 can be suppressed.

Also in the present embodiment, reducing the propagation of vibration of refrigerating machine 160 through magnetic shield 180 to a floor surface having magnetic shield 180 provided thereon can suppress influence of the vibration to precise measuring equipment arranged around superconducting magnet 300.

Hereinafter, a superconducting magnet according to the fourth embodiment of the present invention will be described. Superconducting magnet 400 of the present embodiment is different from superconducting magnet 100 of the first embodiment in a profile and the number of cryostat. Therefore, description as to the same configuration as superconducting magnet 100 of the first embodiment will not be repeated.

(Fourth Embodiment)

Figure 5:
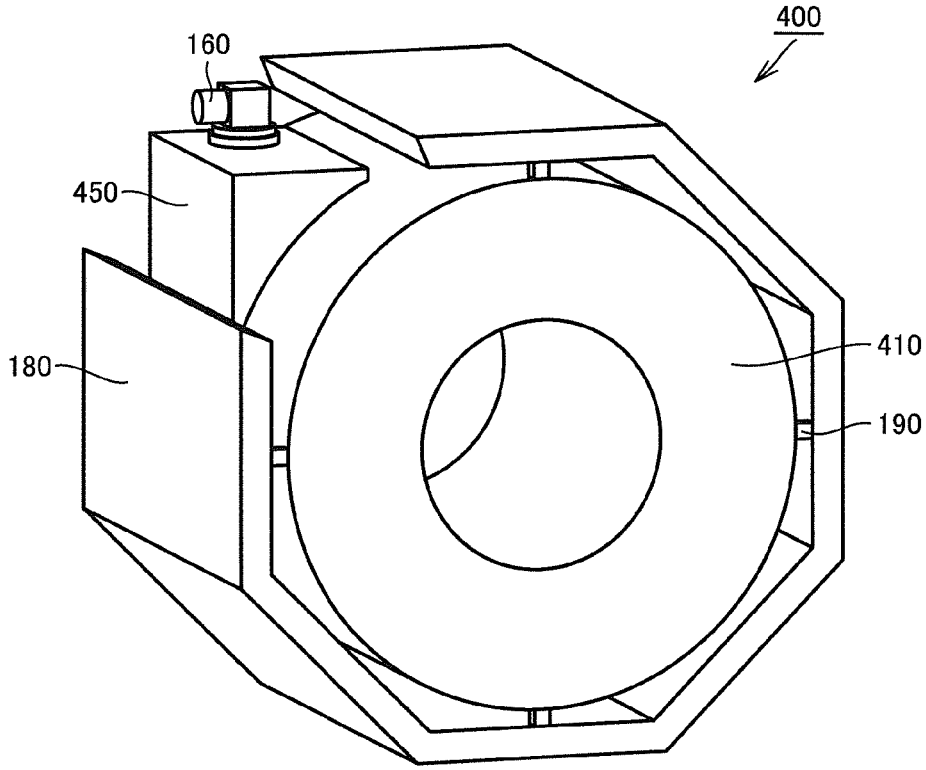
FIG. 5 is a perspective view representing an appearance of a superconducting magnet according to a fourth embodiment of the present invention.

FIG. 5 is a perspective view representing an appearance of a superconducting magnet according to the fourth embodiment of the present invention. As shown in FIG. 5, in superconducting magnet 400 according to the fourth embodiment of the present invention, a profile of cryostat 410, in other words, a profile of a vacuum chamber, is substantially cylindrical. In cryostat 410, a part having refrigerating machine 160 provided thereon has a protruding portion 450 protruding from an outer peripheral surface of cryostat 410.

Magnetic shield 180 is arranged to have a substantially octagonal shape in a side view in an outer periphery of the cylinder of cryostat 410. However, only the outer side of protruding portion 450 of cryostat 410 does not have magnetic shield 180 positioned thereon.

Magnetic shield 180 abuts against cryostat 410 with elastic bodies 190 therebetween to support cryostat 410. In other words, magnetic shield 180 abuts against the vacuum chamber with elastic bodies 190 therebetween to support the vacuum chamber.

In particular, rubber as elastic body 190 is arranged at opposite end portions in the axial direction of cryostat 410 and on the upper, lower, left, and right sides of cryostat 410. However, the arrangement of elastic bodies 190 is not limited to this, and the elastic bodies 190 is arbitrary as long as it is arranged at a position where cryostat 410 can be supported.

Also in the present embodiment, reducing the propagation of vibration of refrigerating machine 160 through magnetic shield 180 to a floor surface having magnetic shield 180 provided thereon can suppress influence of the vibration to precise measuring equipment arranged around superconducting magnet 400.

Combination of embodiments which can be combined in the embodiment described above shall be envisioned. The superconducting magnet can be used for a magnetic resonance imaging diagnosis device, a nuclear magnetic resonance measuring equipment, and a semiconductor production device.

It should be understood that the embodiments disclosed herein are only by way of examples, and not to be taken by way of limitation. Therefore, the technical scope of the present invention is not limited by the description above, but rather by the terms of the appended claims. Further, any modifications within the scope and meaning equivalent to the terms of the claims are included.

REFERENCE SIGNS LIST

100, 200, 300, 400 superconducting magnet; 110 superconducting coil; 120 bobbin; 130 heat shield; 140 vacuum chamber; 150, 410 cryostat; 160 refrigerating machine; 170, 310 heat conducting body; 180 magnetic shield; 190 elastic body; 210 helium tank; 220 liquid helium; 230 helium pipe; 311, 321 copper braiding wire; 320 part of heat shield; 330 part of vacuum chamber; 340 connection pipe heat shield; 350 bellows; 450 protruding portion.

The invention claimed is:

1. A superconducting magnet, comprising:

a superconducting coil;

a heat shield surrounding said superconducting coil;

a vacuum chamber accommodating said heat shield;

a magnetic shield covering at least a part of said vacuum chamber; and a refrigerating machine fixed to said vacuum chamber to cool said superconducting coil through a heat conducting body, said magnetic shield abutting against an outer surface of said vacuum chamber while having an elastic body therebetween, in a state of being separated from an internal vacuum space of said vacuum chamber without being fixed by means of a connection component, to support said vacuum chamber.

2. A superconducting magnet, comprising:

a superconducting coil;

a helium tank accommodating said superconducting coil and storing liquid helium inside and;

a heat shield surrounding said helium tank;

a vacuum chamber accommodating said heat shield;

a magnetic shield covering at least a part of said vacuum chamber; and a refrigerating machine fixed to said vacuum chamber and liquefying evaporated said liquid helium to cool said superconducting coil, said magnetic shield abutting against an outer surface of said vacuum chamber with an elastic body therebetween, in a state of being separated from an internal vacuum space of said vacuum chamber without being fixed by means of a connection component, to support said vacuum chamber.

3. The superconducting magnet according to claim 2, wherein a tip portion of said refrigerating machine comes in contact with said liquid helium evaporated in said helium tank.

4. The superconducting magnet according to claim 1, wherein said elastic body is made of rubber.

5. The superconducting magnet according to claim 1, wherein said elastic body is a spring.

6. The superconducting magnet according to claim 5, wherein material of said spring is metal.

7. The superconducting magnet according to claim 1, wherein a part of said vacuum chamber including a part having said refrigerating machine fixed thereon is positioned outside of said magnetic shield, and said magnetic shield abutting against said part of said vacuum chamber with said elastic body therebetween to support said vacuum chamber.

8. The superconducting magnet according to claim 1, wherein said vacuum chamber has a substantially cylindrical profile.

9. The superconducting magnet according to claim 1, wherein said superconducting coil, said heat shield, said vacuum chamber, and said refrigerating machine are included in twos, and two said vacuum chambers have a cuboid-like profile, and two said vacuum chambers are arranged to have respective side surfaces facing each other, and said magnetic shield covers a side surface and a bottom surface of said two vacuum chambers, except for the side surfaces facing each other.

10. The superconducting magnet according to claim 2, wherein said superconducting coil, said helium tank, said heat shield, said vacuum chamber, and said refrigerating machine are included in twos, and two said vacuum chambers have a cuboid-like profile, and two said vacuum chambers are arranged to have respective side surfaces facing each other, and said magnetic shield covers a side surface and a bottom surface of said two vacuum chambers, except for the side surfaces facing each other.

11. The superconducting magnet according to claim 2, wherein said elastic body is made of rubber.

12. The superconducting magnet according to claim 2, wherein said elastic body is a spring.

13. The superconducting magnet according to claim 12, wherein material of said spring is metal.

14. The superconducting magnet according to claim 2, wherein a part of said vacuum chamber including a part having said refrigerating machine fixed thereon is positioned outside of said magnetic shield, and said magnetic shield abuts against said part of said vacuum chamber with said elastic body therebetween to support said vacuum chamber.

15. The superconducting magnet according to claim 2, wherein said vacuum chamber has a substantially cylindrical profile.

* * * * *